US006021548A

United States Patent [19]

Temburg

[11] Patent Number: 6,021,548

[45] Date of Patent: Feb. 8, 2000

[54] SLIVER GUIDING DEVICE FOR A FIBER PROCESSING TEXTILE MACHINE

[75] Inventor: Josef Temburg, Jüchen, Germany

[73] Assignee: Trützschler GmbH & Co. KG, Mönchengladbach, Germany

[21] Appl. No.: 09/209,441

[22] Filed: Dec. 11, 1998

[30] Foreign Application Priority Data

Dec. 13, 1997 [DE] Germany ..... 197 55 552

[51] Int. Cl.[7] ..... D01G 25/00

[52] U.S. Cl. ..... 19/150; 19/157; 19/236; 19/288; 492/28; 492/30

[58] Field of Search ..... 19/150, 152, 157, 19/236, 239, 240, 287, 288, 258, 260, 291, 292; 492/28, 30

[56] References Cited

U.S. PATENT DOCUMENTS

| | | | |
|---|---|---|---|
| 552,276 | 12/1895 | Cook | 19/292 |
| 2,198,279 | 4/1940 | Weinberger | 19/258 |
| 2,968,856 | 1/1961 | Allen . | |
| 3,145,429 | 8/1964 | Resor | 19/157 |
| 5,018,248 | 5/1991 | Haworth et al. | 19/240 |
| 5,621,948 | 4/1997 | Hartung | 19/150 |
| 5,855,043 | 1/1999 | Leifeld | 19/150 |

FOREIGN PATENT DOCUMENTS

| | | |
|---|---|---|
| 27 43 571 | 3/1979 | Germany . |
| 39 42 044 | 6/1990 | Germany . |
| 41 30 809 | 3/1993 | Germany . |
| 642890 | 9/1950 | United Kingdom . |
| 1 264 895 | 2/1972 | United Kingdom . |
| 1 476 929 | 6/1977 | United Kingdom . |
| 1 488 938 | 10/1977 | United Kingdom . |

OTHER PUBLICATIONS

Hochleistungsstrecke 730, Prospectus, Zinser Textilmaschinen GmbH, 10 pages.

*Primary Examiner*—Michael A. Neas
*Assistant Examiner*—Gary L. Welch
*Attorney, Agent, or Firm*—Venable; Gabor J. Kelemen

[57] ABSTRACT

A fiber processing textile machine includes a mechanism for advancing a sliver bundle, formed of a plurality of slivers, in a travel path in a direction of sliver feed; and a sliver guiding body positioned in the travel path and having an axis of rotation and a plurality of sliver guiding surfaces disposed about the axis of rotation. The sliver guiding surfaces are of different arcuate shape as viewed perpendicularly to the direction of sliver feed. Further, a holding mechanism is provided for positioning the sliver guiding body and supporting it for rotation for orienting a selected one of the sliver guiding surfaces toward the sliver bundle, whereby the sliver bundle is contacted and guided by the selected surface.

16 Claims, 5 Drawing Sheets

Fig. 1
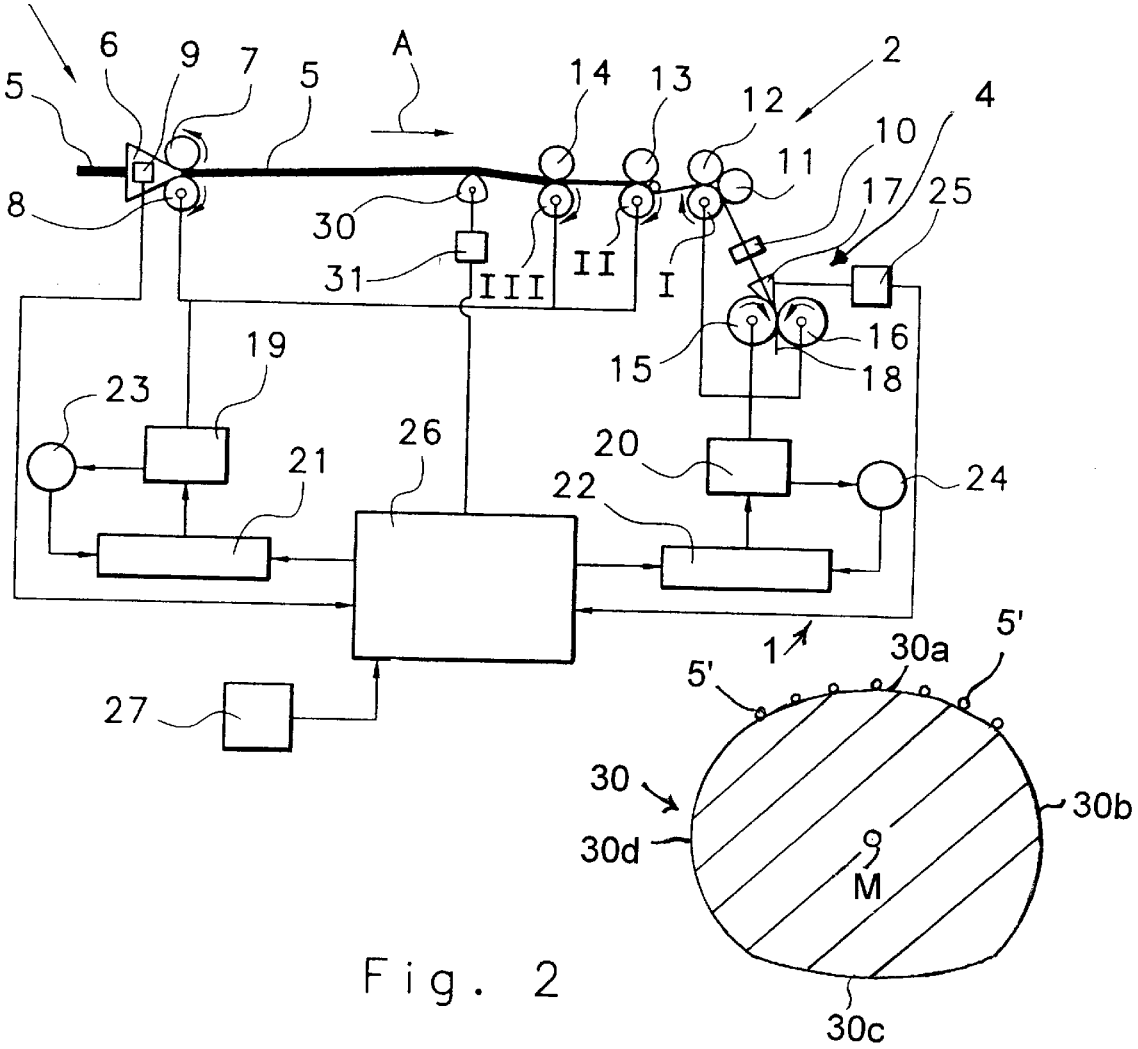
Fig. 2
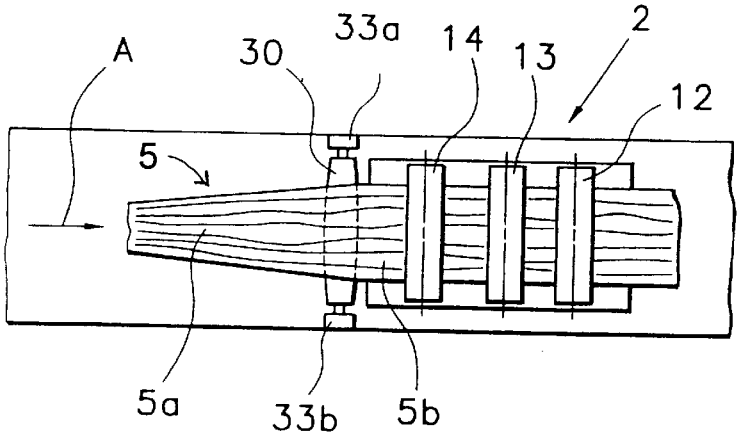
FIG. 2a

SLIVER GUIDING DEVICE FOR A FIBER PROCESSING TEXTILE MACHINE

CROSS REFERENCE TO RELATED APPLICATION

This application claims the priority of German Application No. 197 55 552.7 filed Dec. 13, 1997, which is incorporated herein by reference.

BACKGROUND OF THE INVENTION

This invention relates to a sliver bundle guiding device installed in a fiber processing textile machine. The sliver bundle is formed of a plurality of running slivers, and the sliver guiding device includes a sliver guiding body having a sliver guiding surface on which the slivers are supported. The sliver guiding surface is linear in the sliver advancing direction and is arcuately bent as viewed transversely to such direction. A holding mechanism maintains the guiding body in its set position.

In a known device of the above-outlined type the guiding body is an arcuate, deformable component. For changing the width of the running sliver bundle (that is, the lateral spread of the individual slivers from one another), from each side pressure is exerted on the guiding body thereby changing its arcuate shape. It is a disadvantage of such an arrangement that the setting of a uniform (symmetrical) arcuate shape involves difficulties. In order to achieve a centrally symmetrical arcuate shape, on both sides of the guiding body very accurately identical pressures have to be simultaneously applied. In case of a non-symmetrical arcuate shape of the guiding body, the sliver bundle is introduced into the fiber processing machine in a non-uniform manner which (particularly at high operating speeds) leads to a non-uniform processing and thus to a quality loss in the product.

It is a further disadvantage of the known arrangements that the pressure-applying device on both sides of the guiding body involves substantial expense.

SUMMARY OF THE INVENTION

It is an object of the invention to provide an improved sliver guiding device of the above-outlined type from which the discussed disadvantages are eliminated and which, in particular, is of simple construction and ensures a centrally accurately symmetrical adjustment of different arcuate shapes.

This object and others to become apparent as the specification progresses, are accomplished by the invention, according to which, briefly stated, the fiber processing textile machine which incorporates the invention includes a mechanism for advancing a sliver bundle, formed of a plurality of slivers, in a travel path in a direction of sliver feed; and a sliver guiding body positioned in the travel path and having an axis of rotation and a plurality of sliver guiding surfaces disposed about the axis of rotation. The sliver guiding surfaces are of different arcuate shape as viewed perpendicularly to the direction of sliver feed. Further, a holding mechanism is provided for positioning the sliver guiding body and supporting it for rotation for orienting a selected one of the sliver guiding surfaces toward the sliver bundle, whereby the sliver bundle is contacted and guided by the selected surface.

By providing a rotatable guiding body, whose surface, as viewed circumferentially, has different arcuate shapes, the active guiding surface having the desired arcuate shape may be selected and set in a simple and secure manner by rotating the guiding body. All arcuate shapes are pre-manufactured and therefore they are symmetrically uniform and accurate.

The invention has the following additional advantageous features:

The guiding body is of generally rectangular cross section having rounded edges and surfaces.

The guiding body has an approximately elliptical cross section.

The guiding body has circularly arcuate surfaces of different curvature as viewed circumferentially, and the radius of curvature gradually changes in the circumferential direction.

The radius of curvature is constant within any one of the circumferentially adjoining guiding surfaces.

A driving device such as a drive motor is provided at least at one end face of the guiding body.

An angular position display device such as a graduated disk is secured to an end face of the guiding body.

The driving device turns the guiding body through a predetermined angular extent.

The holding device is steplessly adjustable.

The driving device is connected to an electronic control and regulating device.

Two sliver guiding bodies are serially arranged in the advancing direction of the sliver bundle which is thus in consecutive contact with the sliver bundle-spreading regions of the surfaces of the two guiding bodies.

The guiding body is roller-shaped.

BRIEF DESCRIPTION OF THE DRAWINGS

FIG. 1 is a schematic side elevational view, with block diagram, of a drawing frame incorporating the invention.

FIG. 2 is an enlarged schematic top plan view of one part of the structure shown in FIG. 1, illustrating more details.

FIG. 2*a* is a sectional view of a guiding body according to a preferred embodiment of the invention, taken in a plane which is perpendicular to the direction A shown in FIGS. 1 and 2.

DESCRIPTION OF THE PREFERRED EMBODIMENTS

Figure 3:
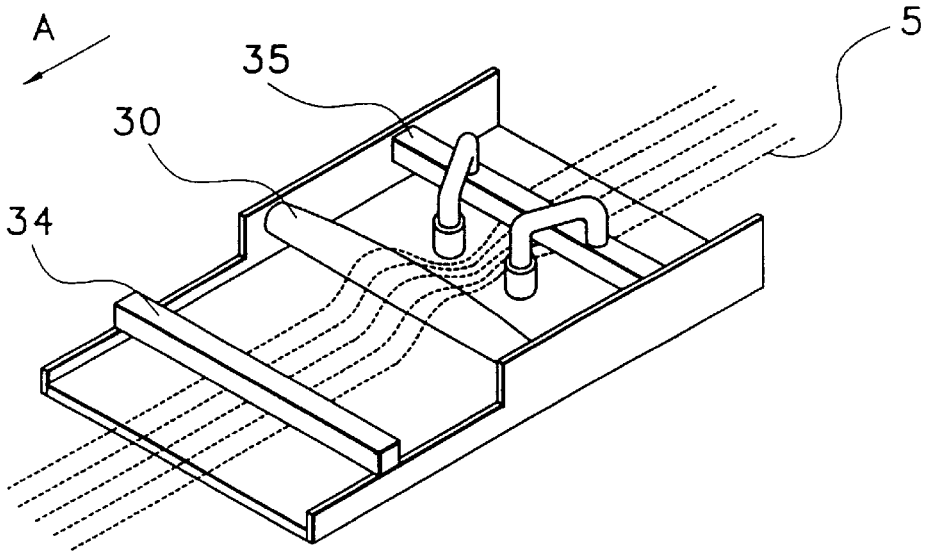
FIG. 3 is a perspective view of a sliver bundle guiding body according to the invention, shown during insertion of the slivers.

FIG. 1 schematically illustrates a drawing frame generally designated at 1 which may be, for example, an HSR model, manufactured by Trützschler GmbH & Co. KG, M önchengladbach, Germany. The drawing frame 1 includes a drawing unit 2 having an inlet end 3 and an outlet end 4. The sliver bundle 5 which is formed of a plurality of slivers withdrawn from sliver coiler cans (not shown), is introduced into a sliver guide 6 and pulled therethrough by means of cooperating withdrawing rolls 7 and 8. The sliver bundle 5 moves past a measuring member 9 as it travels through the sliver guide 6. The arrow A designates the direction of sliver feed through the drawing unit 2.

The illustrated drawing unit 2 is a 4-over-3 drawing unit, that is, it is formed of a lower output roll I, a lower middle roll II and a lower input roll III, as well as four upper rolls 11, 12, 13 and 14. The drawing unit 2 performs a stretching operation on the sliver bundle 5. The stretching operation (drawing) is composed of a preliminary drawing and a principal drawing. The roll pairs 14/III and 13/II form the preliminary drawing field whereas the roll pair 13/II and the roll group 11, 12/I constitute the principal drawing field. The stretched slivers of the sliver bundle 5 are introduced at the outlet end 4 into a guide 10 and are, by means of withdrawing rolls 15 and 16, pulled through a sliver trumpet 17 in which the slivers are gathered to form a single sliver 18 which is subsequently deposited in coiler cans.

The withdrawing rolls 7, 8, the lower input roll III and the lower middle roll II which are mechanically coupled, for example, by a toothed belt, are driven by a regulating motor 19 to which a desired value may be applied. The upper rolls 14 and 13 are driven by frictional engagement with the respective lower rolls III and II. The lower output roll I and the withdrawing rolls 15 and 16 are driven by a principal motor 20. The regulating motor 19 and the principal motor 20 each have their own regulator 21 and 22, respectively. The rpm regulation is effected in each instance by means of a closed regulating circuit wherein a tachogenerator 23 is associated with the regulator 19 and a tachogenerator 24 is associated with the principal motor 20.

At the drawing unit inlet 3 the measuring member 9 measures a sliver magnitude (for example, the cross section) which is proportionate to the sliver mass. At the drawing unit outlet 4 the cross section of the exiting sliver 18 is measured by an outlet measuring member 25 incorporated in the sliver trumpet 17.

A central computing unit (control and regulating device) 26, for example, a microcomputer with microprocessor, transmits signals for setting a desired value to the regulator 21 for the regulating motor 19. The measuring values of both measuring members 9 and 25 are applied to the central computer unit 26 during the drawing operation. The desired value for the regulating motor 19 is determined in the central computer unit 26 from the measuring magnitude of the intake measuring member 9 and the desired value for the cross section of the exiting sliver 18. The measuring values of the outlet measuring member 25 serve for monitoring the exiting sliver 18. With the aid of such a regulating system, fluctuations in the cross section of the inputted sliver bundle 5 may be compensated for by suitable regulations of the drawing process and thus an evening of the sliver 18 may be achieved. The central computer unit 26 is associated with a memory 27 in which signals of the drawing unit control and regulating system are stored for evaluation.

At the inlet of the drawing unit 2, a short distance upstream from the roll pair 14/III a guiding body 30 is arranged which is rotatable about an axis and whose outer surface is in a supportive engagement with the sliver bundle 5. The guiding body 30 which has surface configurations according to the invention as will be described below, is coupled to a driving device, such as a stepping motor 31 which, in turn, is electrically connected to the computer unit 26.

Turning to FIG. 2, before entering the drawing unit 2, the sliver bundle 5 is passed over the guiding body 30. During this occurrence the sliver bundle 5 is spread laterally from its gathered state 5*a* to a laterally spread state 5*b*. The guiding body 30 is a roll-shaped member which is rotatably supported in holding devices 33*a* and 33*b* at its opposite end regions. In this example the rotary axis of the guiding body 30 is perpendicular to the sliver feed direction A.

FIG. 2*a* illustrates a preferred embodiment of the sliver guiding body 30 which is shown in section along a plane which is perpendicular to the direction of sliver feed indicated by the arrow A.

The guiding body 30 has four lateral guiding surfaces 30*a*, 30*b*, 30*c* and 30*d*, and may be turned about its rotary axis M to selectively present one of the guiding surfaces 30*a*–30*d* for engagement by the running fiber bundle 5 composed of a plurality of slivers 5'. The rotary axis M is, in this example, parallel to the direction of sliver feed indicated by the arrow A. In the illustrated example the surface 30*a* is selected as the active, sliver guiding surface.

Each guiding surface 30*a*–30*d* has a different curvature as viewed perpendicularly to the sliver feed direction A. The effect of the sliver guiding surface that is curved perpendicularly to the sliver feed has a spreading effect on the running sliver bundle. Thus, while in the sliver bundle 5 the individual slivers 5' are close together as they run onto the sliver guiding body 30, the curved surface, such as the shown active (operational) surface 30*a* cause the slivers 5' to separate as they run on the surface 30*a*. The extent of separation (spread) of the slivers 5' is a function of the extent of convexity (curvature) of the several guiding surfaces 30*a*–30*d*. Thus, the desired sliver spread may be obtained by selecting the appropriate surface 30*a*–30*d* to act as the operative sliver guiding surface. Such a selection or setting is achieved by turning the sliver guide body 30 about its rotary axis M through a suitable angle. It is noted that viewed parallel to the sliver feed direction A, the guiding surfaces may be linear or may also be curved.

Turning to FIG. 3, prior to the beginning of the drawing operation, the slivers forming the sliver bundle 5 are placed closely side-by-side underneath a first, linear sliver guiding bar 34 and on the upwardly convex surface of the guiding body 30. Thereafter, upstream of the guiding body 30, the slivers of the sliver bundle 5 are positioned closely side-by-side underneath a second straight sliver guiding bar 35.

Figure 4A:
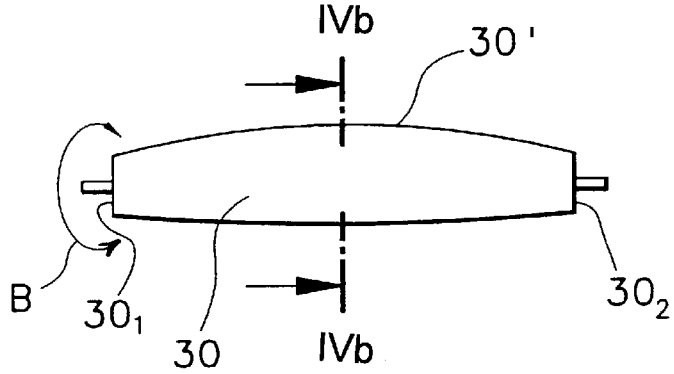
FIG. 4*a* is an end elevational view of a sliver guiding body according to a preferred embodiment, having a roller shape with circumferentially gradually changing crosssectional curvature.
Figure 4B:
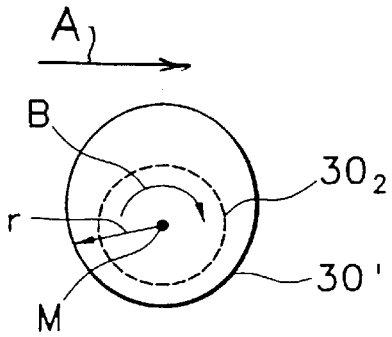
FIG. 4*b* is a sectional view taken along line IVb—IVb of FIG. 4*a*.

The sliver guiding body 30 according to FIG. 4*a* is a roller rotatable in the direction of the double-headed arrow B. As shown in FIG. 4*b*, the arcuate cross-sectional shape of the circularly convex roll surface 30' has varying radii of curvature r. The center of the end face $30_2$ coincides with the axis M which is perpendicular to the direction of sliver feed A. It is seen that the structure of the guiding body 30 of FIGS. 4*a* and 4*b* is such that it is curved both perpendicularly and parallel to the direction of sliver feed A.

Figure 5:
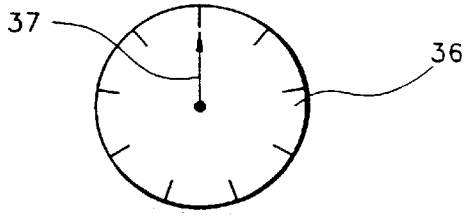
FIG. 5 shows a graduated display disk for attachment to an end face of a sliver guiding body according to the invention.

FIG. 5 shows a graduated disk 36 which may be stationarily held adjacent the end face $30_1$ of the sliver guiding body 30. The disk 36 carries a rotatable pointer 37 which is affixed to the end face $30_1$. In this manner the angular position of the sliver guiding body 30 may be manually set. Also, the pointer 37 visually indicates the manually or automatically set position of the sliver guiding body 30.

Figure 6:
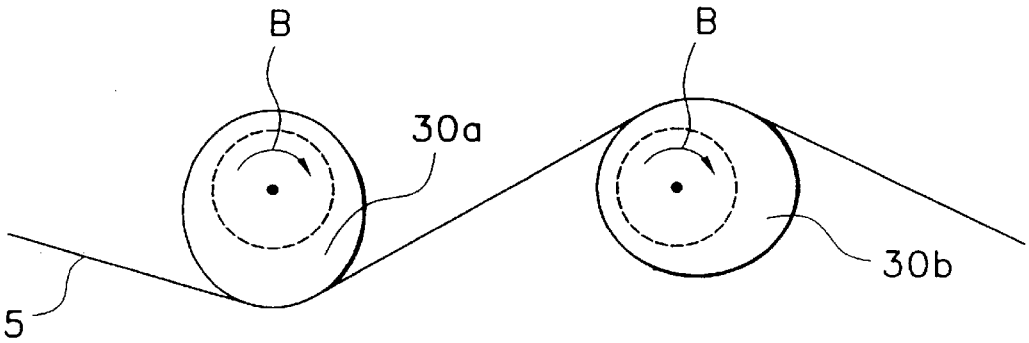
FIG. 6 is a schematic side elevational view illustrating two serially arranged sliver bundle guiding bodies according to the invention.

In the arrangement according to FIG. 6, two sliver guiding bodies 30*a* and 30*b* are serially disposed in the direction of sliver feed. As seen, the sliver 5 is guided and engaged by the bottom surface part of the sliver guiding body 30*a* and by a top surface part of the sliver guiding body 30*b*. In this manner, an infinite number of combinations for the spreading of the sliver bundle 5 may be set. It is noted that in the FIG. 6 illustration spreading of the slivers is caused by the not visible curvatures extending perpendicularly to the sliver feed, that is, perpendicularly to the drawing plane.

Figure 7A:
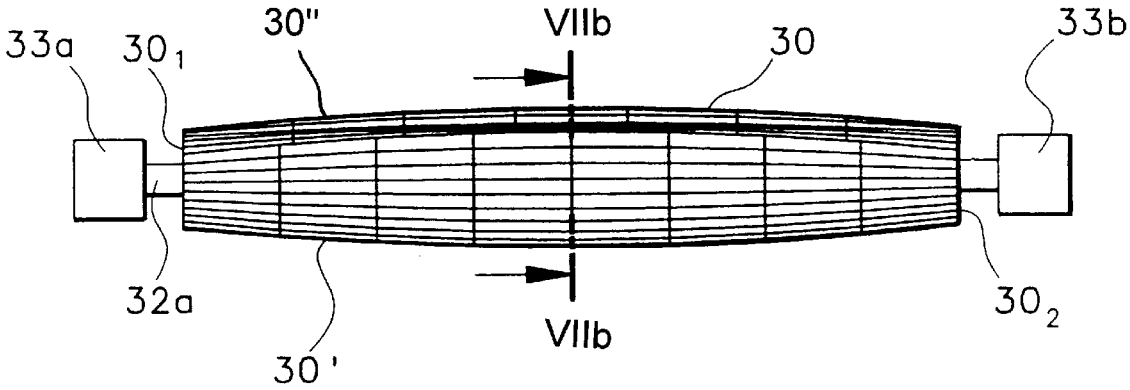
FIG. 7*a* is an end elevational view of another preferred embodiment of a sliver guiding body, whose lateral surface has partial surfaces of different curvature and a rotary axis offset relative to the longitudinal guiding body axis.
Figure 7B:
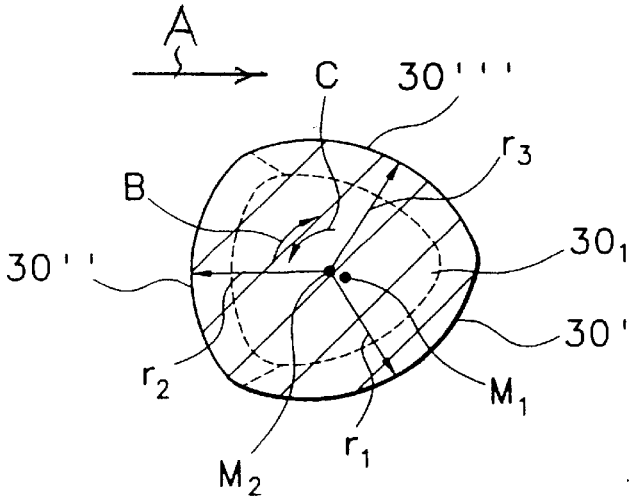
FIG. 7*b* is a sectional view taken along line VIIb—VIIb of FIG. 7*a*.

Turning to FIGS. 7*a* and 7*b*, the convex circumferential surface of the sliver guiding body 30 has three zones 30', 30" and 30'". As seen in FIG. 7*a* in which the sliver feed direction is perpendicular to the drawing plane, the curvatures of the three zones 30', 30" and 30'" are different. As shown in FIG. 7*b*, the radii of curvature $r_1$, $r_2$ and $r_3$, which designate the curvature of the surfaces viewed along a plane parallel to the sliver feed direction A, are identical for the three zones 30', 30" and 30'". The common center for the radii of curvature $r_1$, $r_2$ and $r_3$ is designated at $M_2$. The axis $M_1$ about which the sliver guiding body 30 is rotatable in the direction of the arrows B or C is situated eccentrically with respect to the center $M_2$. This construction is advantageous from the manufacturing point of view because, for example, a milling cutter having a concave milling surface may be used for all three zones 30', 30" and 30'".

Figure 8A:
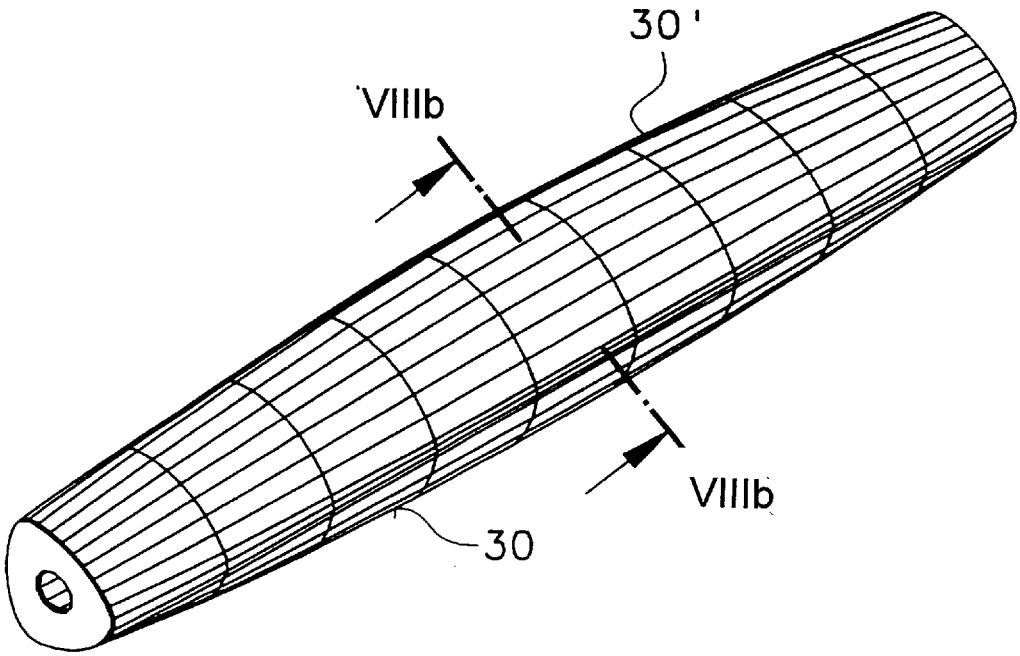
FIG. 8*a* is an end elevational view of another preferred embodiment of a sliver guiding body, whose lateral surface has partial surfaces of different curvature and a rotary axis coinciding with the longitudinal guiding body axis.
Figure 8B:
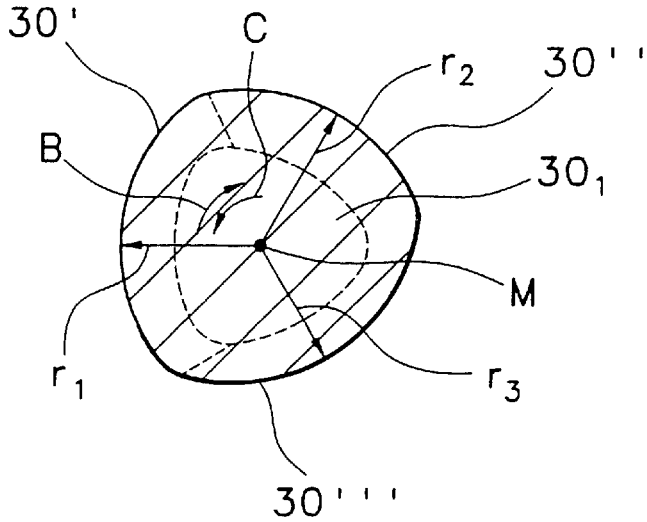
FIG. 8*b* is a sectional view taken along line VIIIb—VIIIb of FIG. 8*a*.

The structure of the guiding body 30 shown in FIGS. 8*a* and 8*b* differs from that of FIGS. 7*a* and 7*b* in that the center (starting point) M of the identical radii of curvature $r_1$, $r_2$ and $r_3$ coincides with the rotary axis of the sliver guiding body 30.

Figure 9A:
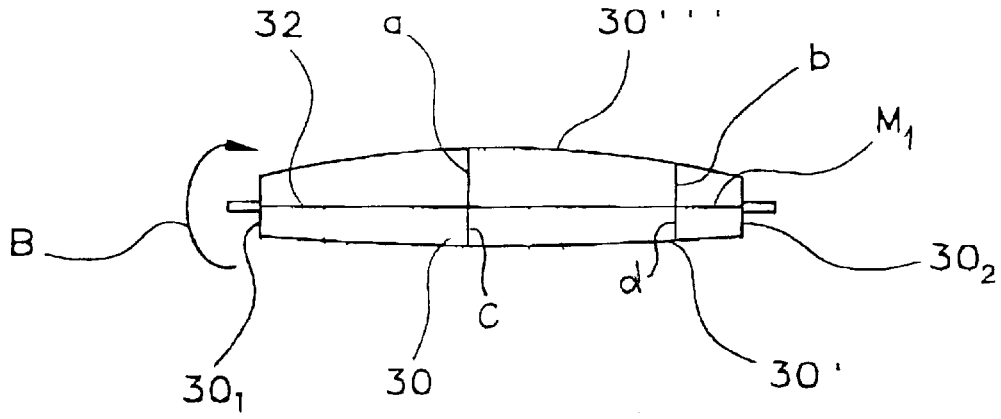
FIG. 9*a* is an end elevational view of a structure similar to that illustrated in FIGS. 8*a* and 8*b*.

In the guiding body 30 of FIG. 9*a*, similarly to the structure shown in FIGS. 8*a* and 8*b*, the longitudinal axis of the body coincides with the rotary axis $M_1$. The sliver guiding surfaces 30' and 30'" have different curvatures as viewed perpendicularly to the sliver feed. The axially spaced distances a and b between the surface 30'" and the axis M are different from one another, and also, the axially spaced distances c and d between the surface 30' and the axis M are different from one another. As further seen in FIG. 9*a*, the distance a is different from the distance c and the distance b is different from the distance d. These distance relationships thus indicate not only curved surfaces, but also that the surfaces are curved differently.

Figure 9B:
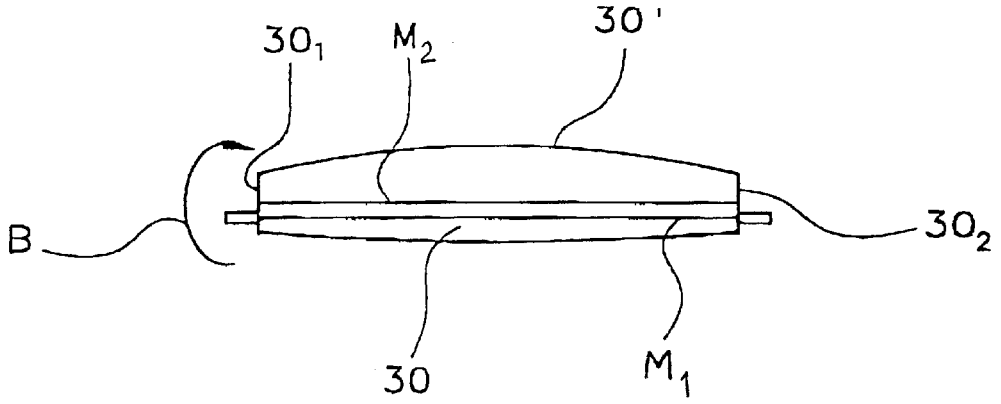
FIG. 9*b* is an end elevational view of a structure similar to that illustrated in FIGS. 7*a* and 7*b*.

In the structure of FIG. 9*b*, similarly to FIGS. 7*a* and 7*b*, the the rotary axis $M_1$ is offset relative to longitudinal body axis $M_2$.

Figure 10:
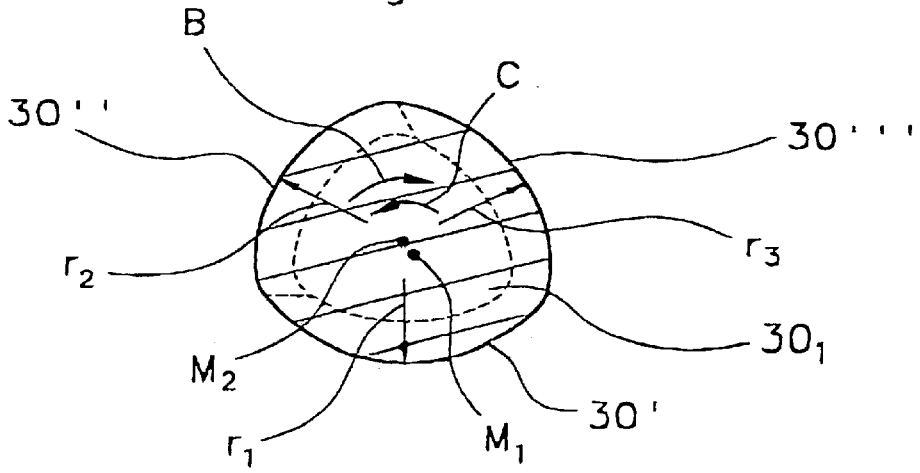
FIG. 10 is a sectional view similar to that of FIG. 7*b*.

In FIG. 10 the radii $r_1$, $r_2$ and $r_3$ are identical and while they all intersect in the axis $M_2$, they do not start from $M_2$, that is, they do not have a common starting point. By virtue of the fact that the rotary axis $M_1$ is offset relative to the longitudinal body axis $M_2$ (also shown in FIGS. 7*b* and 9*b*), upon rotation of the guiding body 30 about the rotary axis $M_1$, a different distance of the respective active surface areas 30', 30" and 30'" from the rotary axis $M_1$ and thus a different lateral spread is obtained.

While in all of the above-described embodiments the surfaces are arranged on the sliver guiding body such that the adjusting motion of the guiding body is a rotary motion for placing the selected surface into the working position, it is feasible, for example, to provide the various surfaces side-by-side on an upper surface of a plate-like guiding body. In such a case the adjusting motion of the guiding body may be a linear shifting displacement in a horizontal direction, perpendicularly to the travel path (feed direction) of the sliver.

It will be understood that the above description of the present invention is susceptible to various modifications, changes and adaptations, and the same are intended to be comprehended within the meaning and range of equivalents of the appended claims.

What is claimed is:

1. A fiber processing textile machine comprising (a) means for advancing a sliver bundle in a travel path in a direction of sliver feed; the sliver bundle being formed of a plurality of slivers;

(b) a sliver guiding body positioned in said travel path and having (1) an axis of rotation; and (2) a plurality of sliver guiding surfaces disposed about said axis of rotation; said surfaces being of different arcuate shape as viewed perpendicularly to said direction of sliver feed; and (c) holding means for supporting said sliver guiding body for rotation about said axis for orienting a selected one of said surfaces toward said sliver bundle for causing said selected surface to contact and guide said sliver bundle.

2. The fiber processing textile machine as defined in claim 1, wherein said sliver guiding body, as viewed in a section perpendicularly to said axis, has a polygonal shape having rounded edges and sides.

3. The fiber processing textile machine as defined in claim 1, wherein said sliver guiding body has an approximately elliptical shape as viewed in a section perpendicular to said axis.

4. The fiber processing textile machine as defined in claim 1, wherein said sliver guiding body has an end face; further comprising a drive motor connected to said end face for rotating said sliver guiding body.

5. The fiber processing textile machine as defined in claim 4, wherein said drive motor is a stepping motor for rotating said sliver guiding body through a predetermined angle.

6. The fiber processing textile machine as defined in claim 4, further comprising an electronic control and regulating device; said drive motor being connected to said electronic control and regulating device.

7. The fiber processing textile machine as defined in claim 1, further comprising a stepless setting device for steplessly rotating said sliver guiding body.

8. The fiber processing textile machine as defined in claim 1, wherein said sliver guiding body has an end face; further comprising a display device connected to said end face for indicating an angular position of said sliver guiding body.

9. The fiber processing textile machine as defined in claim 8, wherein said display device includes a stationarily supported graduated disk and a pointer affixed to said end face for rotating with said sliver guiding body in unison.

10. The fiber processing textile machine as defined in claim 1, wherein said sliver guiding body is roll-shaped.

11. The fiber processing textile machine as defined in claim 1, wherein said surfaces have a convex curvature as viewed parallel to said direction of sliver feed.

12. The fiber processing textile machine as defined in claim 11, wherein said convex curvature has a different radius of curvature for different said surfaces.

13. The fiber processing textile machine as defined in claim 11, wherein said convex curvature has the same radius of curvature for different said surfaces.

14. The fiber processing textile machine as defined in claim 1, wherein said surfaces are convex as viewed perpendicularly to said direction of sliver feed.

15. The fiber processing textile machine as defined in claim 1, wherein said fiber processing textile machine is a drawing frame including a drawing unit having an inlet; said sliver guiding body being arranged at said inlet.

16. A fiber processing textile machine comprising (a) means for advancing a sliver bundle in a travel path in a direction of sliver feed; the sliver bundle being formed of a plurality of slivers;

(b) a sliver guiding body positioned in said travel path and having a plurality of sliver guiding surfaces; said surfaces being of different arcuate shape as viewed in a direction perpendicularly to said direction of sliver feed; and (c) holding means for adjustably supporting said sliver guiding body for an adjusting displacement of said sliver guiding body relative to said travel path to place a selected one of said surfaces into a working position in which the sliver bundle is contacted and guided by said selected surface.

* * * * *